US007151463B2

(12) United States Patent
Hsu

(10) Patent No.: US 7,151,463 B2
(45) Date of Patent: Dec. 19, 2006

(54) BURGLAR ALARM DEVICE

(76) Inventor: Chih-Hung Hsu, 12F-3, No. 267, Gongguan Rd., West Dist., Taichung (TW)

( * ) Notice: Subject to any disclaimer, the term of this patent is extended or adjusted under 35 U.S.C. 154(b) by 85 days.

(21) Appl. No.: 10/969,858

(22) Filed: Oct. 22, 2004

(65) Prior Publication Data

US 2006/0087444 A1 Apr. 27, 2006

(51) Int. Cl.
*G08B 7/00* (2006.01)

(52) U.S. Cl. ..... 340/693.5; 340/545.1

(58) Field of Classification Search ..... 340/545.1, 340/545.5, 545.7, 545.8, 540
See application file for complete search history.

(56) References Cited

U.S. PATENT DOCUMENTS 5,469,139 A * 11/1995 Ko ..... 340/545.4
5,900,815 A * 5/1999 Story ..... 340/548
2003/0218541 A1* 11/2003 Sakai ..... 340/545.1

* cited by examiner

*Primary Examiner*—Jeffery Hofsass
*Assistant Examiner*—Shirley Lu
(74) *Attorney, Agent, or Firm*—Rosenberg, Klein & Lee

(57) ABSTRACT

A burglar alarm device has a body and a mounting bracket. The body has a casing, a rear cover and a detection and alarm assembly. The detection and alarm assembly is mounted on the rear cover inside the casing and has a vibration sensor and an illumination source. The body is attached to the optional mounting bracket. When a door-frame with the burglar alarm device is touched, the detection and alarm assembly will sound an audible alarm to warn people in the house, and the illumination source will light up. Further, the illumination source can be turned on to illuminate the keyhole so a person can easily insert a key.

3 Claims, 6 Drawing Sheets

BURGLAR ALARM DEVICE

BACKGROUND OF THE INVENTION

1. Field of Invention

The present invention relates to a burglar alarm device, more particularly to a burglar alarm device that has an illumination capability.

2. Description of the Related Art

In recent years, the number of burglaries has been increasing steadily. Owners and occupants of buildings and homes often install burglar alarm devices to stop, deter or detect burglaries. However, conventional burglar alarm devices are either complex and expensive or ineffective, and except for the most expensive conventional burglar alarm devices do not provide an illumination capability. Thus, a real need exists today for a simple and inexpensive burglar alarm device that is effective and will deter or stop burglaries.

SUMMARY OF THE INVENTION

The primary objective of the present invention is to provide an inexpensive and effective burglar alarm device.

The burglar alarm device in accordance with the present invention is mounted on a doorframe and has a body and a mounting bracket. The body has a casing, a rear cover and a detection and alarm assembly. The detection and alarm assembly is mounted on the rear panel of the body inside the casing and has a vibration sensor, an audible alarm and a source of illumination. The body is attached to the mounting bracket.

When a doorframe with the burglar alarm device is touched, the vibration sensor will activate the audible alarm to warn people in the house, and the source of illumination will light up. Further, the illumination source can be turned on to illuminate the keyhole so a person can easily insert a key.

Other objectives, advantages and novel features of the invention will become more apparent from the following detailed description when taken in conjunction with the accompanying drawings.

DETAILED DESCRIPTION OF THE INVENTION

Figure 1:
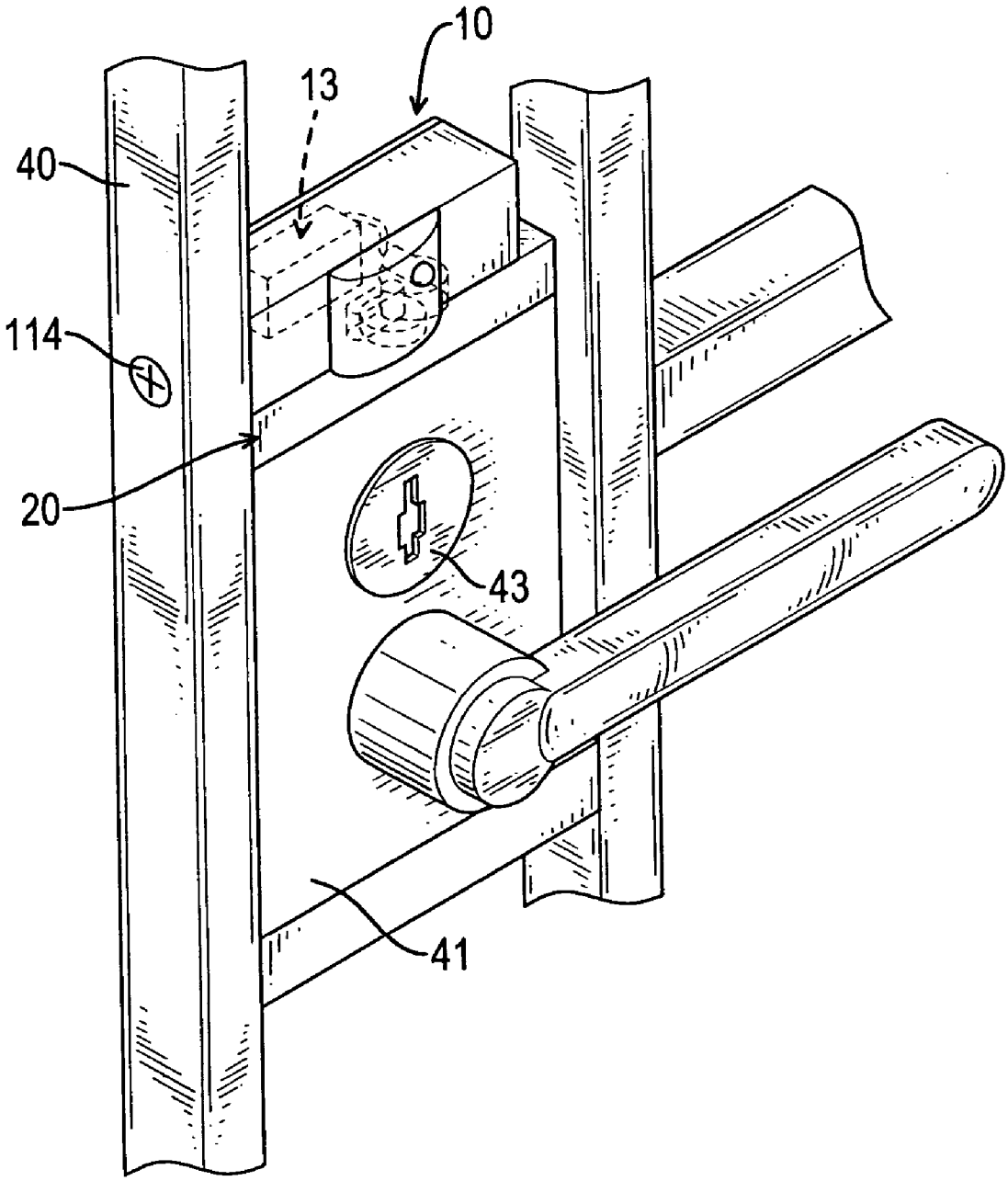
FIG. 1 is a perspective view of a burglar alarm device in accordance with the present invention mounted on a doorframe.
Figure 2:
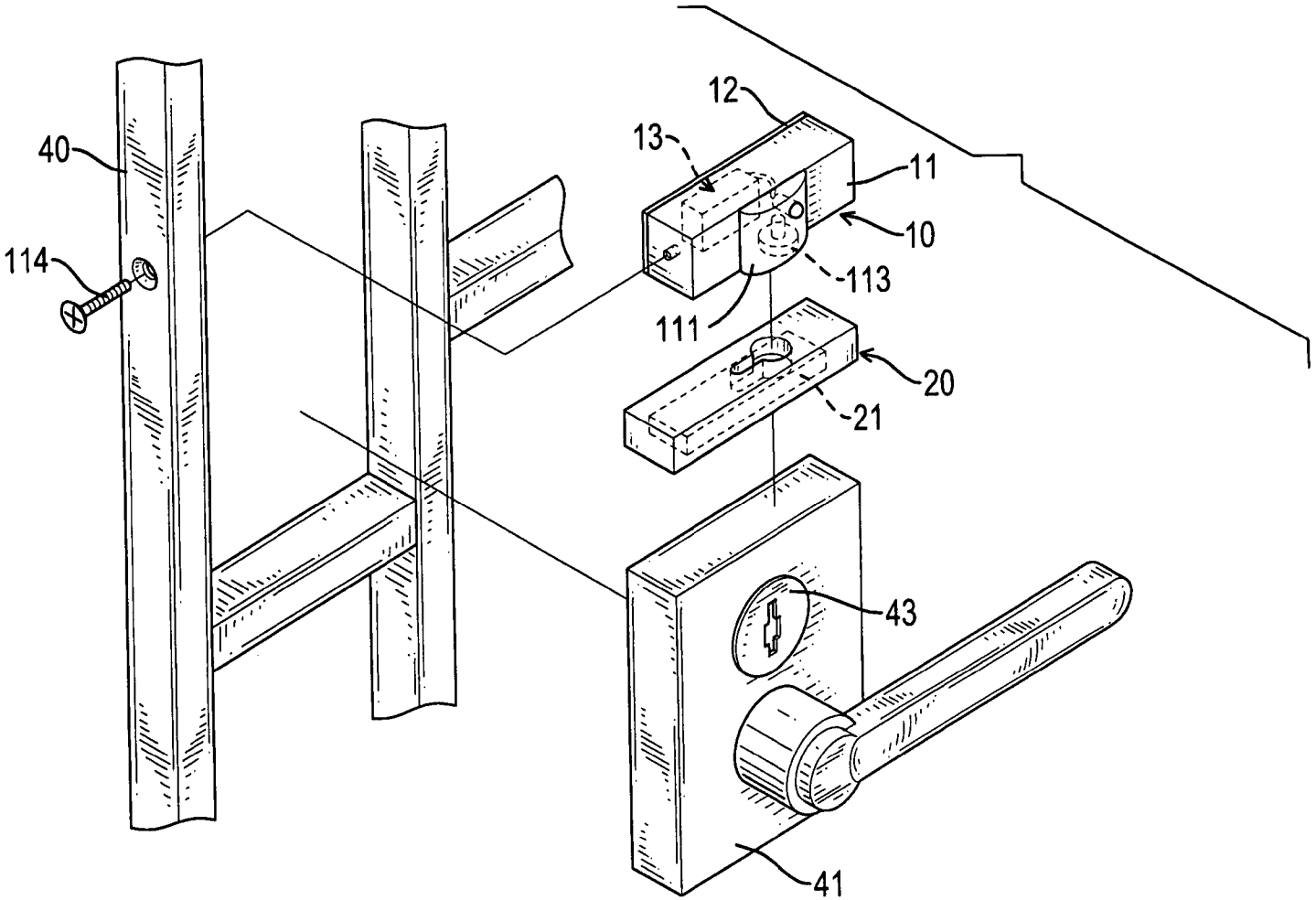
FIG. 2 is an exploded perspective view of the burglar alarm device in FIG. 1.
Figure 3:
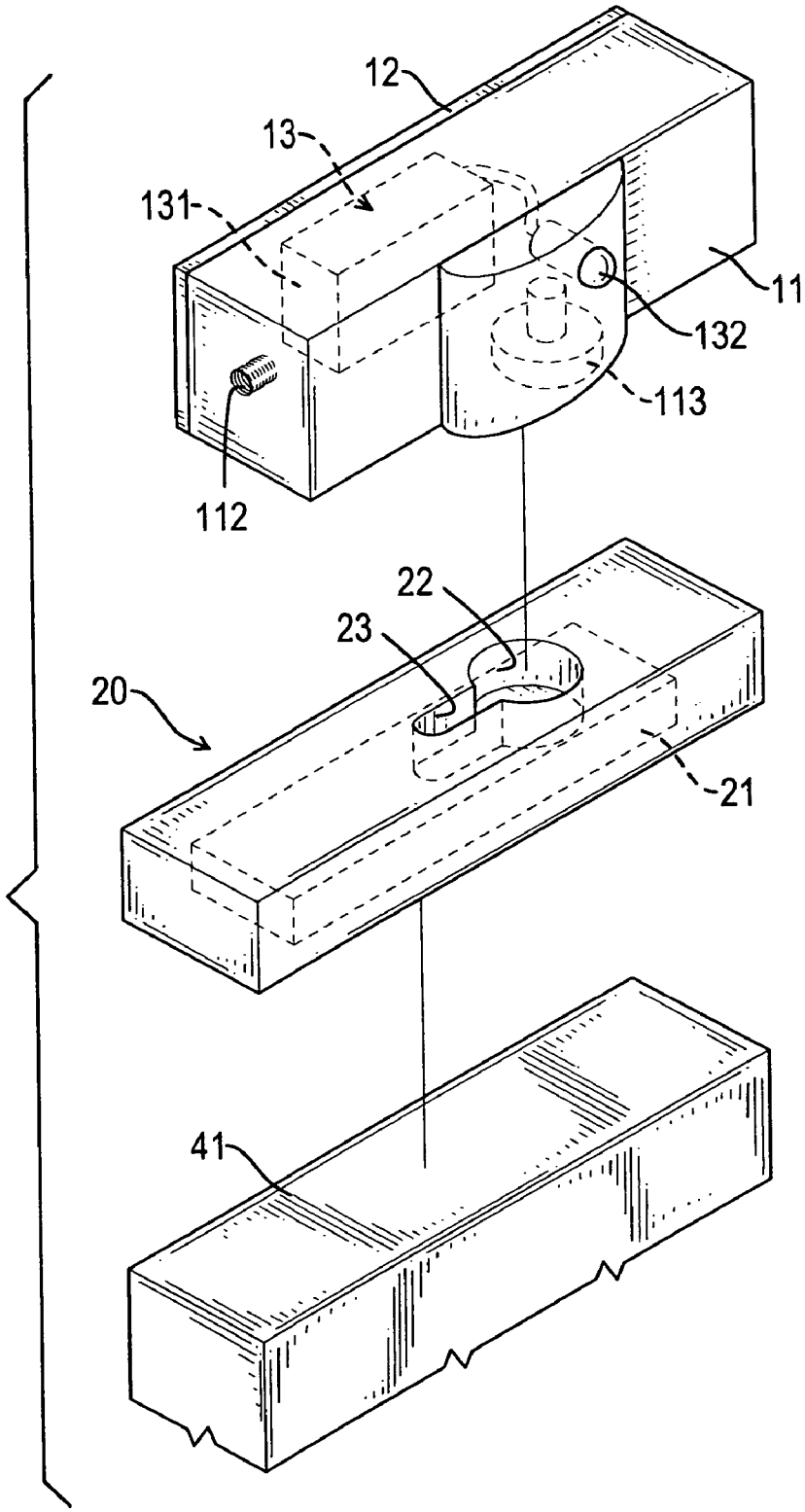
FIG. 3 is an exploded perspective view of the burglar alarm device in FIG. 1.

With reference to FIGS. 1 to 3, a burglar alarm device in accordance with the present invention has a body (10) and a mounting bracket (20).

The body (10) can be formed in many shapes, such as a box or an ovoid, and is attached to a doorframe or the mounting bracket (20). In a preferred embodiment, the body (10) has a casing (11), a rear cover (12) and a detection and alarm assembly (13). The casing (11) has a front, a rear, a top, a bottom, two sidewalls, a cavity, a convex window (111), a threaded hole (112), a post (113) and a screw (114). The front has four side edges and a front surface. The top, the bottom and the two sidewalls are respectively flush with the side edges of the front, so that the cavity is formed. The convex window (111) is a transparent material and integrally extends out from the front surface of the front. The threaded hole (112) is defined in one of the sidewalls of the casing (11). The post (113) is formed on the bottom of the casing (11) and has a distal end and a flange. The flange has a diameter and is formed on the distal end of the post (113). The screw (114) is screwed through the doorframe and into the threaded hole (112) in the casing (11). The rear cover (12) is mounted on the rear of the casing (11) and has an inner surface. The detection and alarm assembly (13) is mounted on the inner surface of the rear cover (12) and has a vibration sensor (131) and an illumination source (132). The illumination source (132) can be incandescent bulbs, LEDs or anything that can light up. The illumination source (132) is connected to the vibration sensor (131). When the body (10) is touched or moved, the vibration sensor (131) will sound an audible alarm, and the illumination source (132) will light up.

The mounting bracket (20) holds the body (10) and has a top surface, a bottom surface, a recess (21), a through hole (22) and a slot (23). The recess (21) is defined in the bottom surface of the mounting bracket (20). The through hole (22) is defined through the mounting bracket (20) and corresponds to the post (113) on the body (10) and has a diameter. The diameter of the through hole (22) is larger than the flange on the post (113). The slot (23) is defined in the mounting bracket (20) and communicates with the through hole (22). The slot (23) has a width and the width is smaller than the diameter of the through hole (22).

Figure 4:
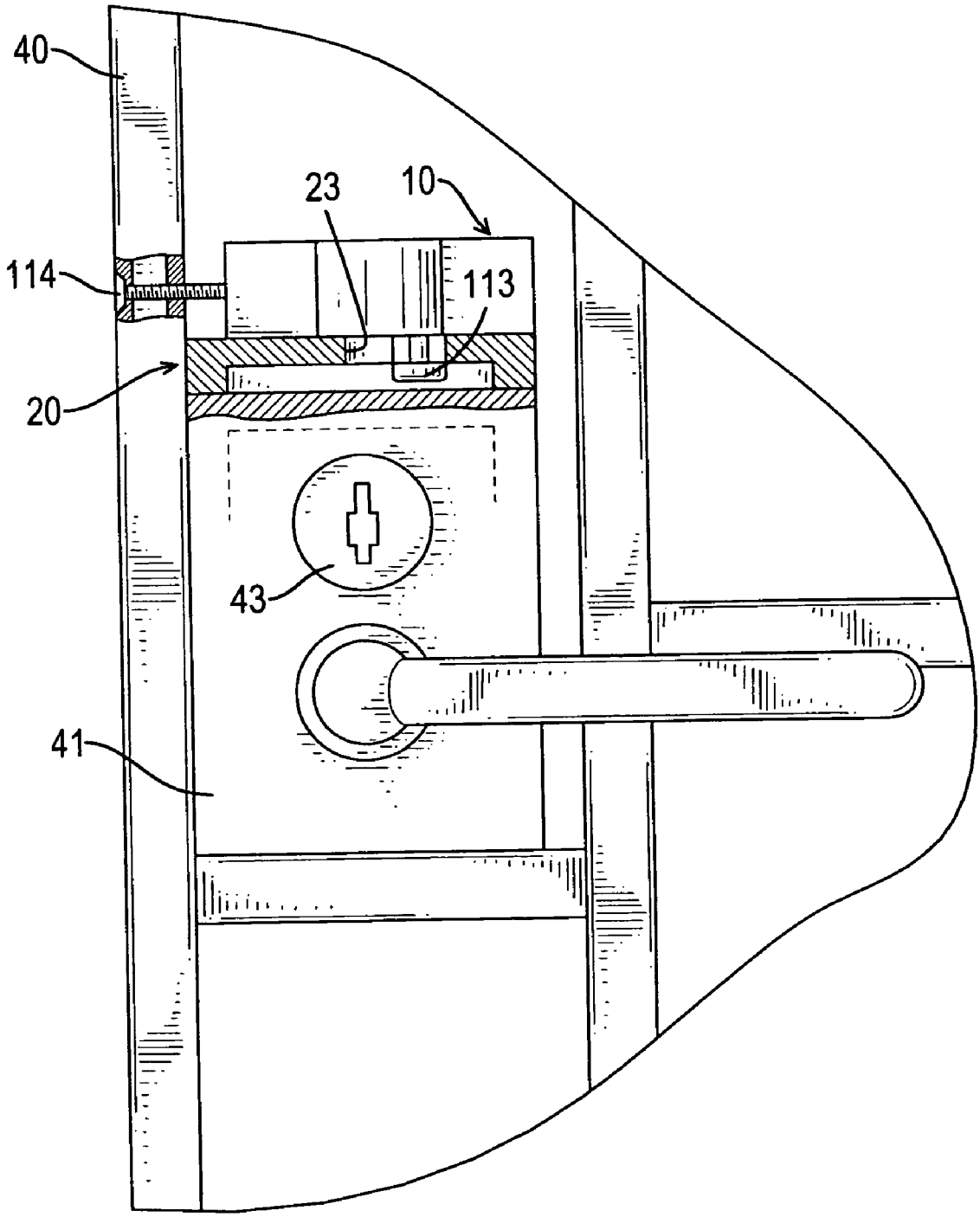
FIG. 4 is an operational front view in partial section of the burglar alarm device in FIG. 1 when the body is not locked in the mounting bracket.
Figure 5:
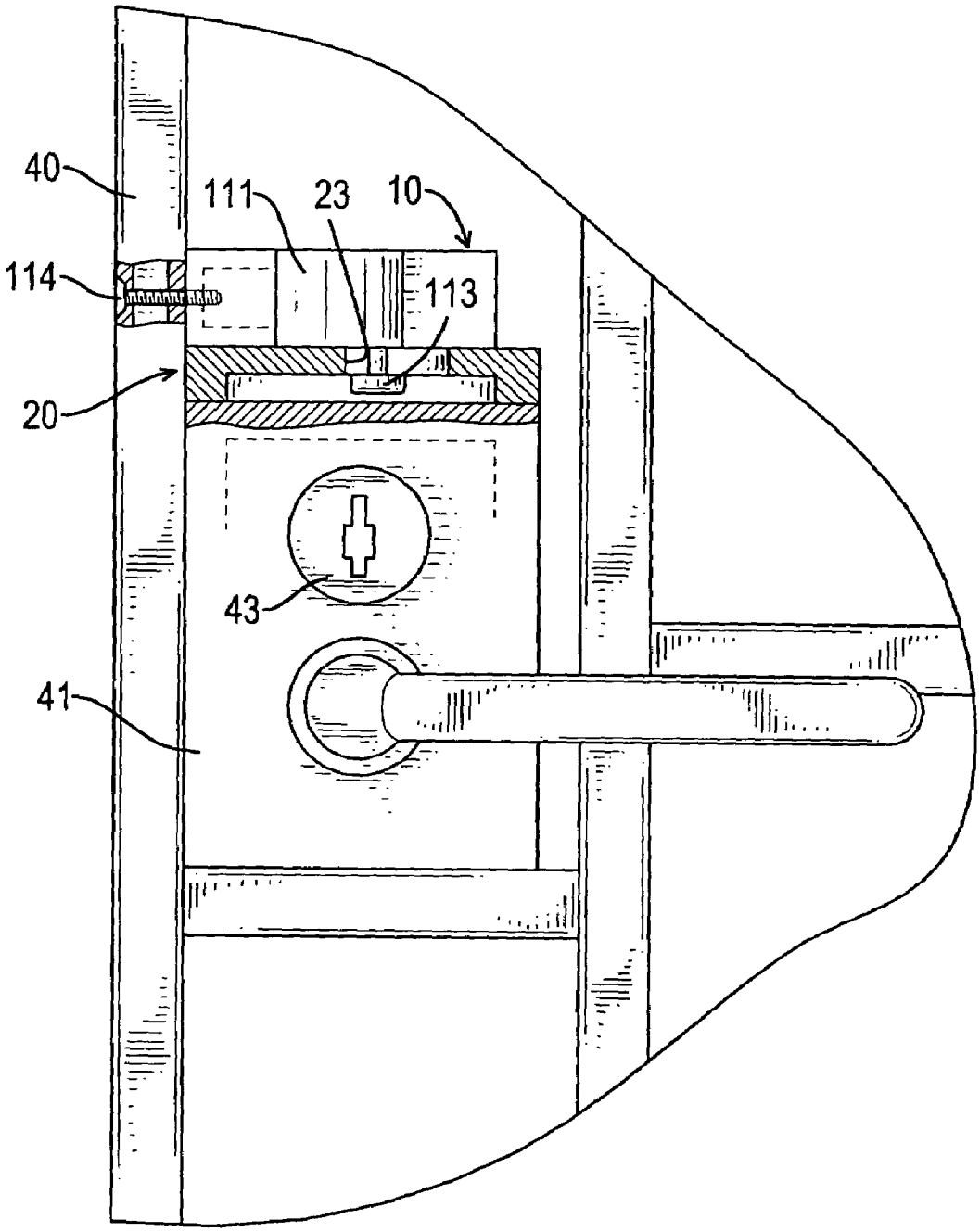
FIG. 5 is an operational front view in partial section of the burglar alarm device in FIG. 1 when the body is locked in the mounting bracket.
Figure 6:
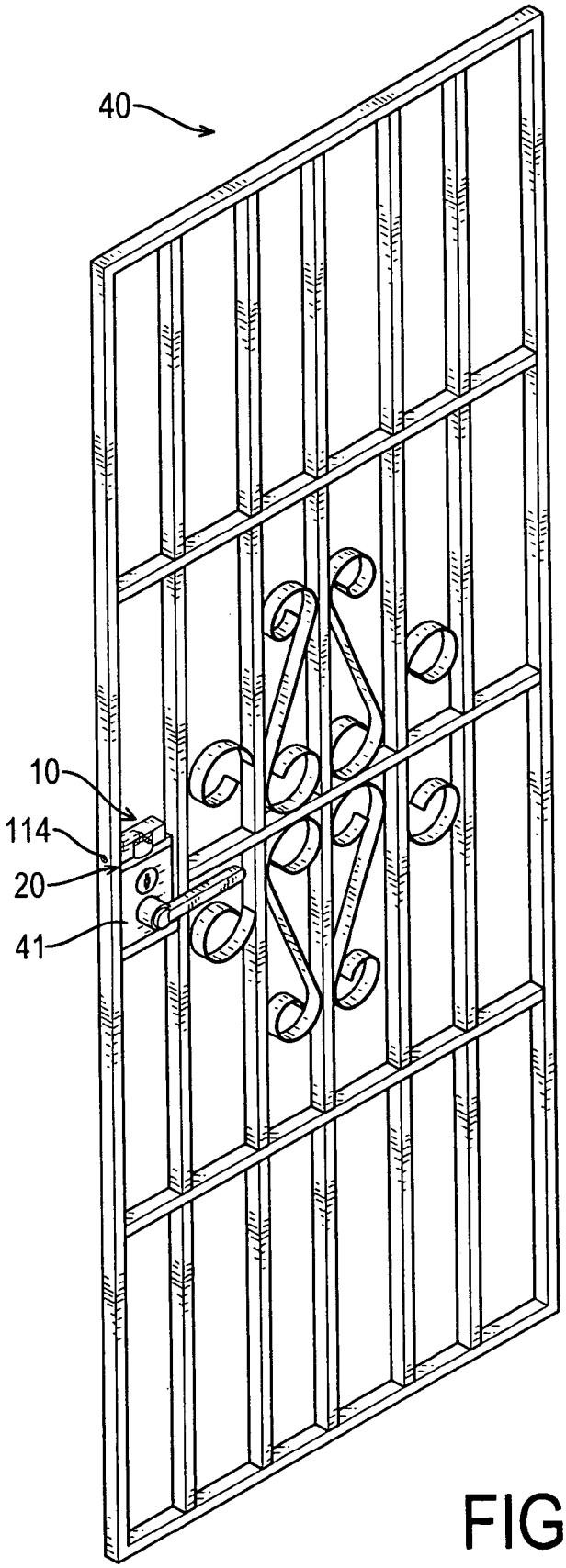
FIG. 6 is an operation perspective view of the burglar alarm device in FIG. 1.

With reference to FIGS. 4 to 6, the burglar alarm device is installed by attaching the mounting bracket (20) to a door lock (41). The flange on the post (113) of the body (10) is inserted through the through hole (22) in the mounting bracket (20). The body (10) is moved, so that the flange of the post (113) is held by the slot (23) in the mounting bracket (20). Then, the screw (114) is passed through the doorframe (40) and screwed into the body (10) to hold the body (10) securely in place.

When a person touches the doorframe with the burglar alarm device, the detection and alarm assembly (13) inside the body (10) activates an audible alarm to warn people in the house, and the illumination source (132) connected to the detection and alarm assembly (13) will light up. When a person wants to light a keyhole (43) on the door, the person simply touches the door, and the detection and alarm assembly (13) inside the body (10) activates the audible alarm and the illumination source (132) that shines light on the keyhole (43).

The advantages of the burglar alarm device in accordance with the present invention include the following.

1. Fewer elements are inside the body (10), and assembling and repairing the body (10) is simple.

2. The burglar alarm device also provides an illuminating function, so that a person can find a keyhole in the key lock easily.

3. Because the elements of the body (10) are fewer and the device is simple to assemble, the burglar alarm device in accordance with the present invention will be inexpensive.

The invention may be varied in many ways by a person skilled in the art. Such variations are not to be regarded as a departure from the spirit and scope of the invention, and all such modifications are intended to be included within the scope of the following claims.

What is claimed is:

1. A burglar alarm device comprising a body having a casing having a front having four side edges and a front surface, a rear, a top flush with one of the side edges of the front, a bottom flush with one of the side edges of the front, two sidewalls flush with two of the side edges of the front, a cavity formed between the front, the top and two side edges, a post formed on the bottom of the casing and having a distal end, and a flange formed on the distal end of the post and having a diameter, and a convex window being a transparent material and integrally extending out from the front surface of the front, and a rear cover mounted on the rear of the casing and having an inner surface, a detection and alarm assembly mounted on the inner surface of the rear cover and having a vibration sensor, and an illumination source connected to the vibration sensor; and a mounting bracket to hold the body and having a top surface, a bottom surface, a through hole defined through the mounting bracket, corresponding to the post on the body and having a diameter, and a slot defined in the mounting bracket, communicating with the through hole and having a width, wherein the diameter of the through hole is larger than the diameter of the flange on the post, and the width of the slot is smaller than the diameter of the flange on the post.

2. The burglar alarm device as claimed in claim 1, wherein the casing of the body further comprises a threaded hole defined in one of the sidewalls of the body, a screw adapted for passing through a doorframe and screwing into the threaded hole in the case, the mounting bracket further comprises a recess defined in the bottom surface, wherein the diameter of the through hole is larger than the diameter of the flange on the post, and the width of the slot is smaller than the diameter of the flange on the post.

3. The burglar alarm device as claimed in claim 2, wherein the illumination source is LED.

* * * * *